US005564130A

United States Patent [19]

Feng

[11] Patent Number: 5,564,130

[45] Date of Patent: Oct. 15, 1996

[54] DIVING MASK WITH A SOFT NOSE PROJECTION AND A DRAIN MECHANISM

[76] Inventor: Le-Jang Feng, 1 Fl., No. 22-10, Lane 50, Tien Mu E. Rd., Taipei, Taiwan

[21] Appl. No.: 324,933

[22] Filed: Oct. 18, 1994

[51] Int. Cl.[6] ..... A61F 9/02

[52] U.S. Cl. ..... 2/428; 128/207.12

[58] Field of Search ..... 2/428, 430, 429, 2/426; 128/207.12, 207.13, 200.29, 201.28

[56] References Cited

U.S. PATENT DOCUMENTS

| | | | |
|---|---|---|---|
| 3,122,962 | 3/1964 | De Angelis | 2/441 X |
| 4,077,068 | 3/1978 | Anderson | 2/428 |
| 5,329,643 | 7/1994 | Sato | 2/428 |

*Primary Examiner*—Peter Nerbun
*Attorney, Agent, or Firm*—Pro-Techtor International

[57] ABSTRACT

A soft nose projection diving mask with a drain mechanism wherein a through hole is provided at the nose bottom of a nose projection body of the soft nose projection diving mask, and a drain valve mechanism consisting of an upper valve cover and a lower valve cover is engaged with and through the through hole. The upper or lower valve cover is provided with an unidirectional valve diaphragm that opens outward so that the soft nose projection diving mask has a natural drain activated by the diver's exhalation. The nose projection body is soft and is used in the operation of "balancing pressure". An assembly plate is formed on the bottom surface of the nose bottom of the nose projection body. A bridge frame is formed at one end of the assembly plate and conforms to the shape of the bridge portion of the nose projection body. The assembly plate is also provided with a valve diaphragm guard cover to cover the lower side of the lower valve cover.

11 Claims, 10 Drawing Sheets

DIVING MASK WITH A SOFT NOSE PROJECTION AND A DRAIN MECHANISM

BACKGROUND OF THE INVENTION

1. Field of the Invention

,The present invention is related to a diving mask with a soft nose projection and a drain mechanism. The mask also facilitates "balancing pressure" when diving.

2. Description of the Prior Art

A diving mask is one piece of equipment necessary for a diver. The mask helps the diver see clearly in the water, and protects the diver's eyes.

The soft lining frame of the diving mask is generally made of soft rubber so as to tightly and closely contact the diver's face. However, people's facial patterns differ from one another. Therefore, the diving mask cannot completely and closely contact all diver's faces, so water will enter the diving mask through a portion without a close contact between the mask and the face. When too much water is accumulated in the mask, the diver's breathing and vision will be seriously affected. Accordingly the accumulated water must be drained from time to time.

Therefore, a diver has to learn how to drain his mask before diving, particularly if he is diving with a "water lung" (deep water diving). If no drain valve is provided in the diving mask, the diver has to use his hand to press the upper edge of the diving mask, pull open the lower edge of the mask, and blow out any accumulated water by means of a nasal exhalation. However, such a draining procedure is inconvenient, and the diver has to be skillful, so beginners or unskilled divers may panic while attempting to drains their masks. If the diving mask is provided with a drain valve, the diver can directly blow out the accumulated water in the mask from the drain valve through his nasal exhalation. This construction is more convenient.

In addition, when diving with a water lung, in order to stay in the water for a long time, the diver is normally equipped with a water lung air cylinder (oxygen cylinder), and can breathe the air from the oxygen cylinder (which is a mixture of about 79% nitrogen and 21% oxygen), by cylinder. If there is no drain valve provided in the diving mask, the diver proceeds with exhalation and inhalation through his mouth. This can lead to a failure to entirely exhaust the nitrogen, and can cause nitrogen poisoning (i.e. the so-called nitrogen drunkenness which is similar to liquor drunkenness in that it can cause a disoriented state). If the diver is submerged long enough, and the diver's breathing only through his mouth can also cause his throat to become very dry and uncomfortable. However, the diving mask is provided with a drain valve, the diver can proceed with a self-regulated procedure of natural breathing through inhalation through mouth and exhalation (and drain) with his nose. Then the passage of his exhalation differs from that of his inhalation, and both his inhalation and exhalation are very smooth and comfortable. Also, nitrogen will not tend to accumulate in the diver's body, so that the diver will not be subject to nitrogen drunkenness.

In addition, when diving with the water lungs, because the water pressure at one depth differs from that of another depth )the deeper the water, the higher the water pressure), the diver needs to "balance pressure" when he changes depth. If he does not, the higher water pressure will lead to discomfort in the diver's ears, such as tinnitus. The so-called "balancing pressure" done to prevent the gradually increasing water pressure from disturbing the diver's ears in the course of his descent. The operation of "balancing pressure" is as follows: Prior to diving down to another depth, the diver first tightly shuts his mouth and holds his nose tightly shut with his fingers then exhales; the pressure will go to his ears to resist the increasing water pressure and the diver release his fingers from holding his nose after he reaches his desired depth.

At present, diving masks may be divided into two general categories: hard nose projection diving masks and soft nose projection diving masks. The hard nose projection diving mask (a) is shown in FIGS. 1 and 2. It is monocular and comprises a goggle frame (11), a soft lining frame (12) and a fixed frame: a soft lining frame (12) is nested in the inner flange (15) of fixed frame (13) through the frame rim (14). The goggle frame (11) is applied over the fixed frame (13), and both the goggle frame (11) and the inner flange (15) of the fixed frame (13) jointly hold the frame rim of the soft lining frame (12). The two sides of the fixed frame (13) can be provided with a head belt to affix the diving mask on the diver's head. The goggle frame (11) is designed to install a monocular glass (16) and integrally molded with a nose projection body (17) which is a hard nose projection made of the same material as that of the goggle frame (11). A valve hole can be conveniently provided in a suitable position (normally at the bottom of the nose) to form a valve seat for holding a valve diaphragm and to form a drain valve which opens outward unidirectionally to allow the water accumulated in the diving mask to drain outward from within, but to prevent water from seeping into the diving mask through the drain valve. Two nose-holding recesses (18) which are slanted inward are formed at the bottom of soft-lining frame (12) correspond to the positions of the nostrils of the diver. This allows the diver to close his nose to "balance pressure".

The soft nose projection diving mask has two types: monocular and binocular (the binocular type can be equipped with a binocular lens to accommodate nearsighted diver). The soft nose projection diving mask (B) as shown in FIGS. 3 and 4 comprises a goggle frame (2), a soft lining frame (3), two lenses (4), (4) and two fixed hoops (41), (41). The soft lining frame (3) has two separate frame rims (31), (31), a nose projection body (32) made of the same material as that of the soft lining frame (3). Lenses (4), (4) are mounted between the rims (31), (31) and the two separate inner flanges (21), (21) of goggle frame (2). The two sides of the goggle frame (2) may be provided with a head belt for affixing the diving mask to the diver's head.

Through a comparison of the advantages and disadvantages of hard and soft nose projection diving masks, it can be seen that the advantages of the hard nose projection diving mask consist in the direct disposition of a drain valve for convenient draining. the disadvantages thereof consist in (1) During the operation of "balancing pressure", the diver cannot hold his nose directly with his fingers because the nose projection body is hard. Further, the regulator in his mouth is an obstacle. The diver has to first bend his hand and then extend his hand upward into the interior of the nose-holding recesses of the soft lining so that he can hold his nose, making the operation of "balancing pressure" very inconvenient: (2) During the operation of "balancing pressure", the diver uses two index fingers of his two hand to extend upward into the interior to hold his nose as mentioned above, but if the diver holds other appliances such as a spear in his hand, he must hold the appliance in his armpit or between his legs to free his two hands; and (3) the lens is monocular and unable to accommodate the nearsighted diver.

So far as the soft nose projection diving mask is concerned, the advantages thereof consist in that due to the soft nose projection body, during the operation of "balancing pressure", the diver can directly hold the soft nose projection body from without. He can use a thumb and an index finger of one hand to close his nose, so that the operation of "balancing pressure" is very simple, quick, and convenient. A nearsighted diver can also choose a binocular lenses. However, the disadvantages thereof consist in the soft nose projection body having an unstable base. It can therefore not directly support a drain valve. Manufacturers in the past have never though of disposing a drain valve on the soft nose projection body, and no soft nose projection diving mask with a drain valve has never appeared in the market.

SUMMARY OF THE INVENTION

In view of the above, the inventor has developed the present invention in which the object is to offer a soft nose projection diving mask with a drain mechanism to achieve the purposes of fine drainage and simple operation of "balancing pressure" at the same time.

The present invention comprises a through hole, an upper valve cover, and a lower valve cover in a nose bottom of a nose projection body of the soft nose projection diving mask. The upper and lower valve covers are engaged with each other through the through hole. The upper or lower valve cover is provided with a unidirectional valve diaphragm which is able to open outward only, so that the soft nose projection diving mask has a drain effect, and the soft nose projection body can be used in the operation of "balancing pressure".

The present invention further comprises an assembly plate at the nose bottom of the nose projection body and between the nose bottom and the lower valve cover. The upper and lower valve covers are assembled through the nose bottom and the assembly plate to reinforce and stabilize the base of the nose bottom to support the upper and lower valve covers. The assembly plate and the lower cover can be integrally molded.

The present invention further comprises a valve diaphragm guard cover to cover the lower side of the lower valve cover and to have an opening toward the lower edge at the rear end of the nose button, so as to prevent the valve diaphragm from coming off and to prevent foreign objects from entering the diaphragm. The guard cover also aids the draining process.

As an alternate embodiment of the present invention, the above-mentioned assembly plate can be extended as a bridge frame to extend along the bridge of the nose projection body. It can be inserted in the clearance between the upper end of the bridge and goggle frame so as to protect the bridge from directly colliding with other objects and to stabilize the nose projection body.

DETAILED DESCRIPTION OF THE PREFERRED EMBODIMENTS

Figure 1:
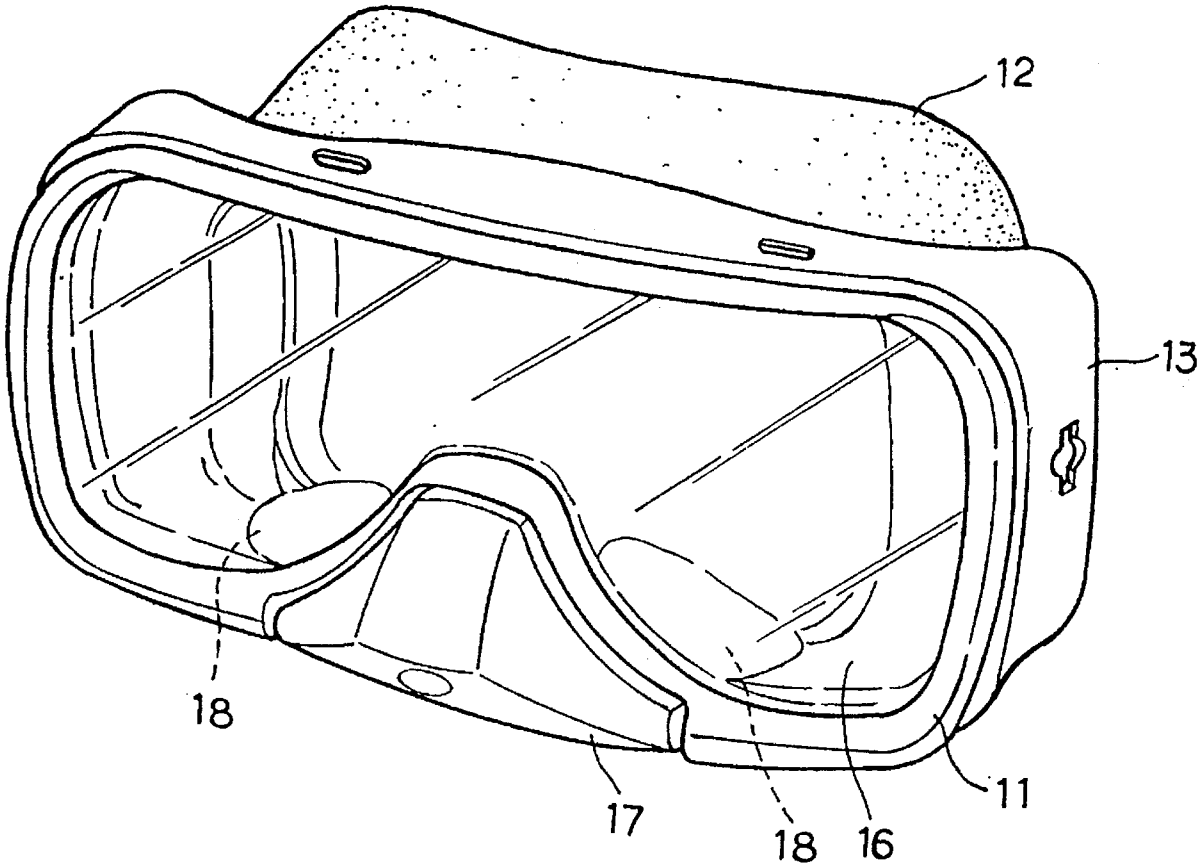
FIG. 1 (Prior Art)
FIG. 1 is an elevational view of a conventional hard nose projection diving mask.
Figure 2:
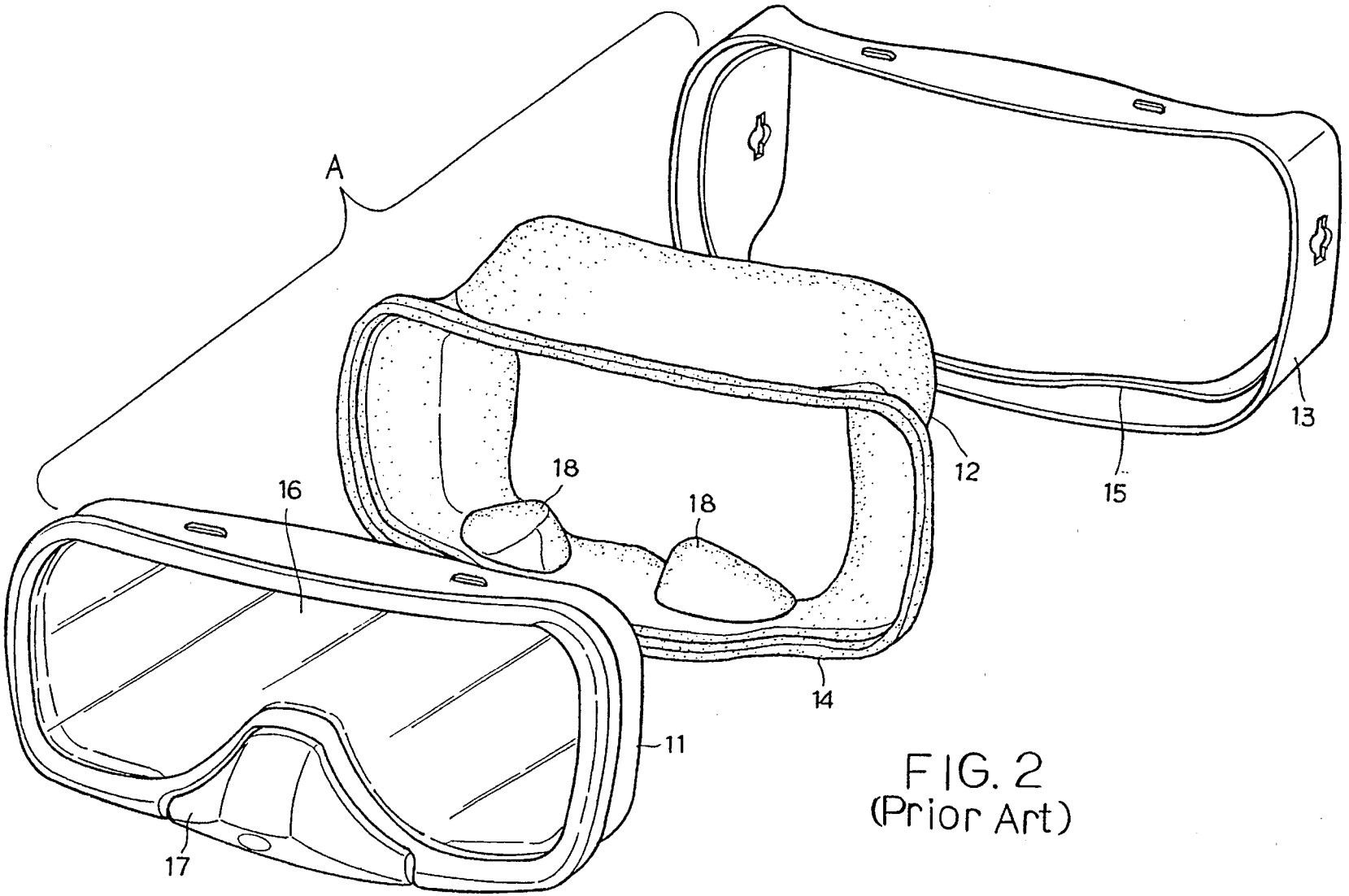
FIG. 2 (Prior Art)
FIG. 2 is an exploded view of FIG. 1.
Figure 3:
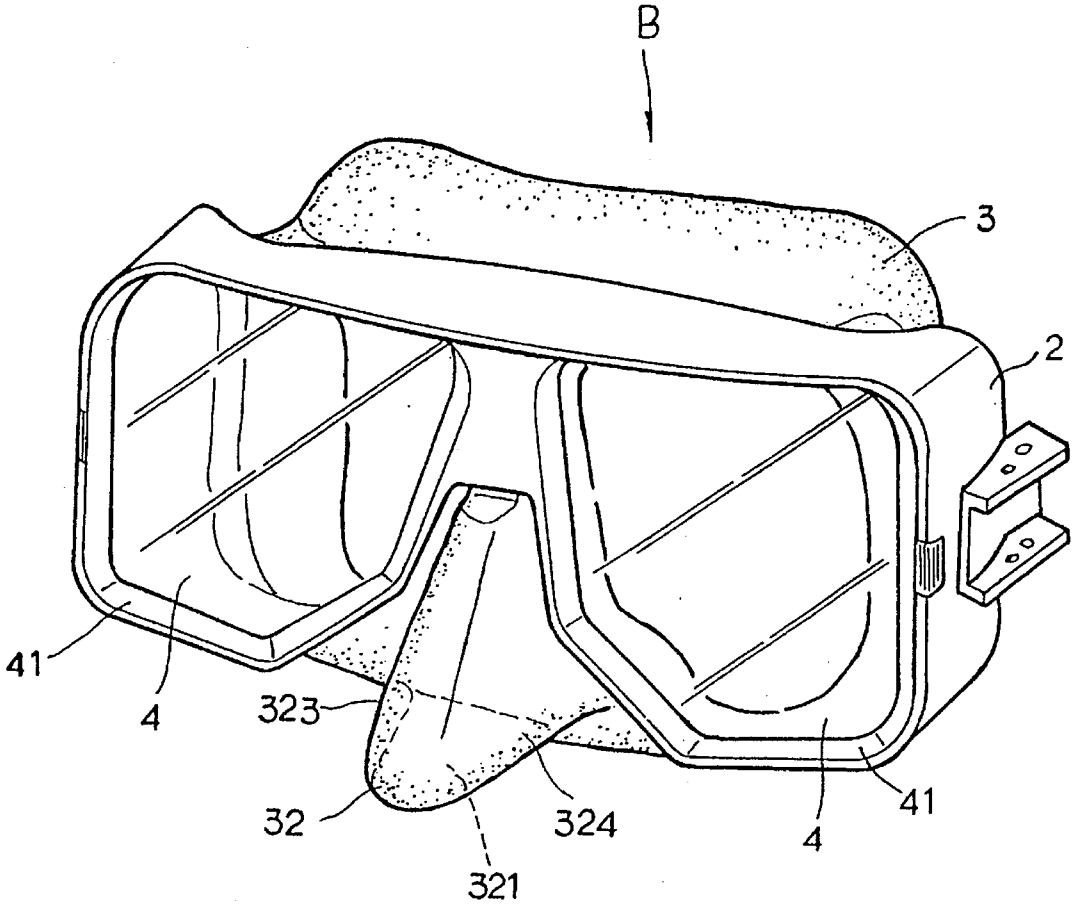
FIG. 3 (Prior Art)
FIG. 3 is an elevational view of a conventional soft nose projection diving mask.
Figure 4:
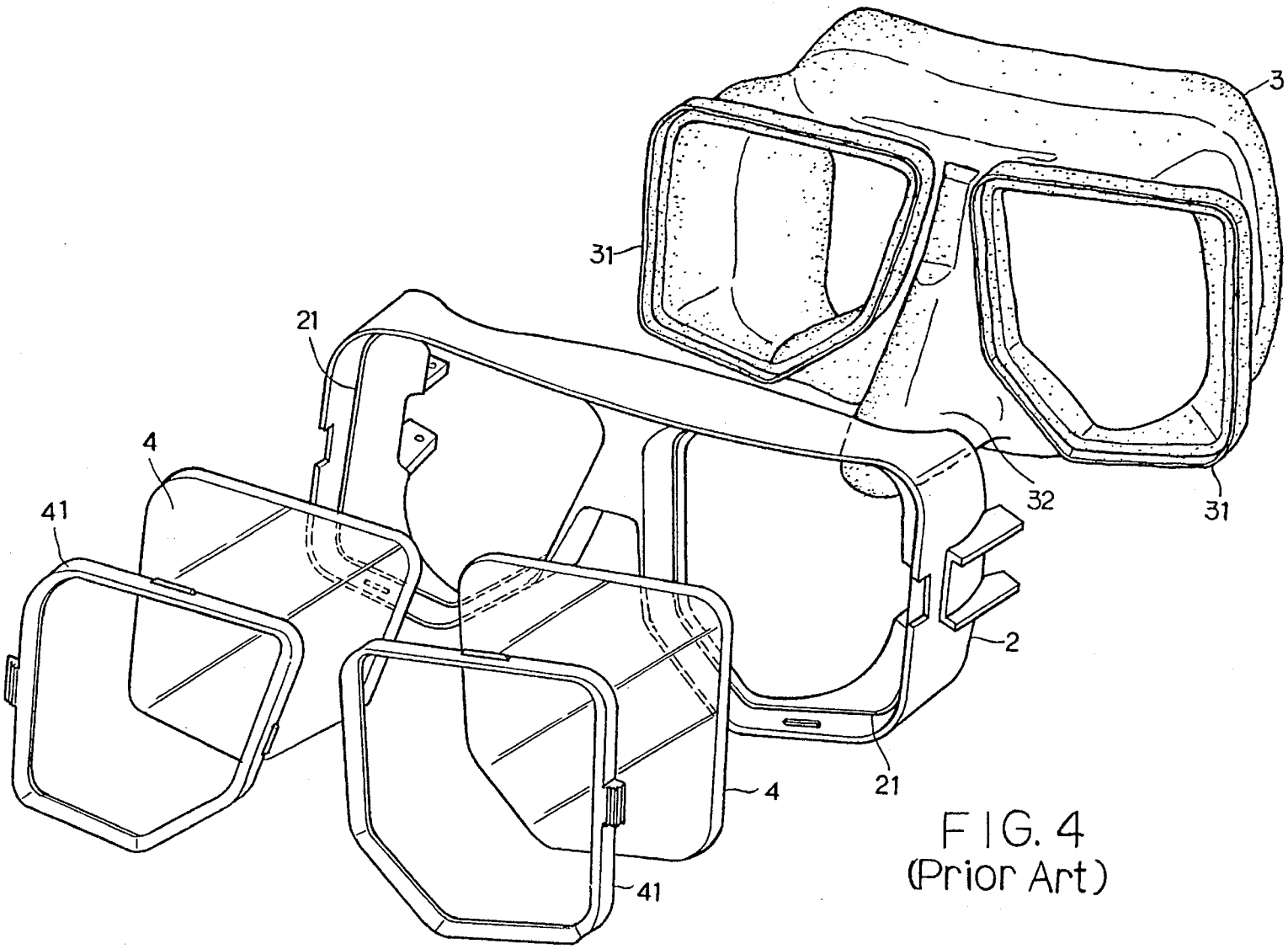
FIG. 4 (Prior Art)
FIG. 4 is an exploded view of FIG. 3.
Figure 5:
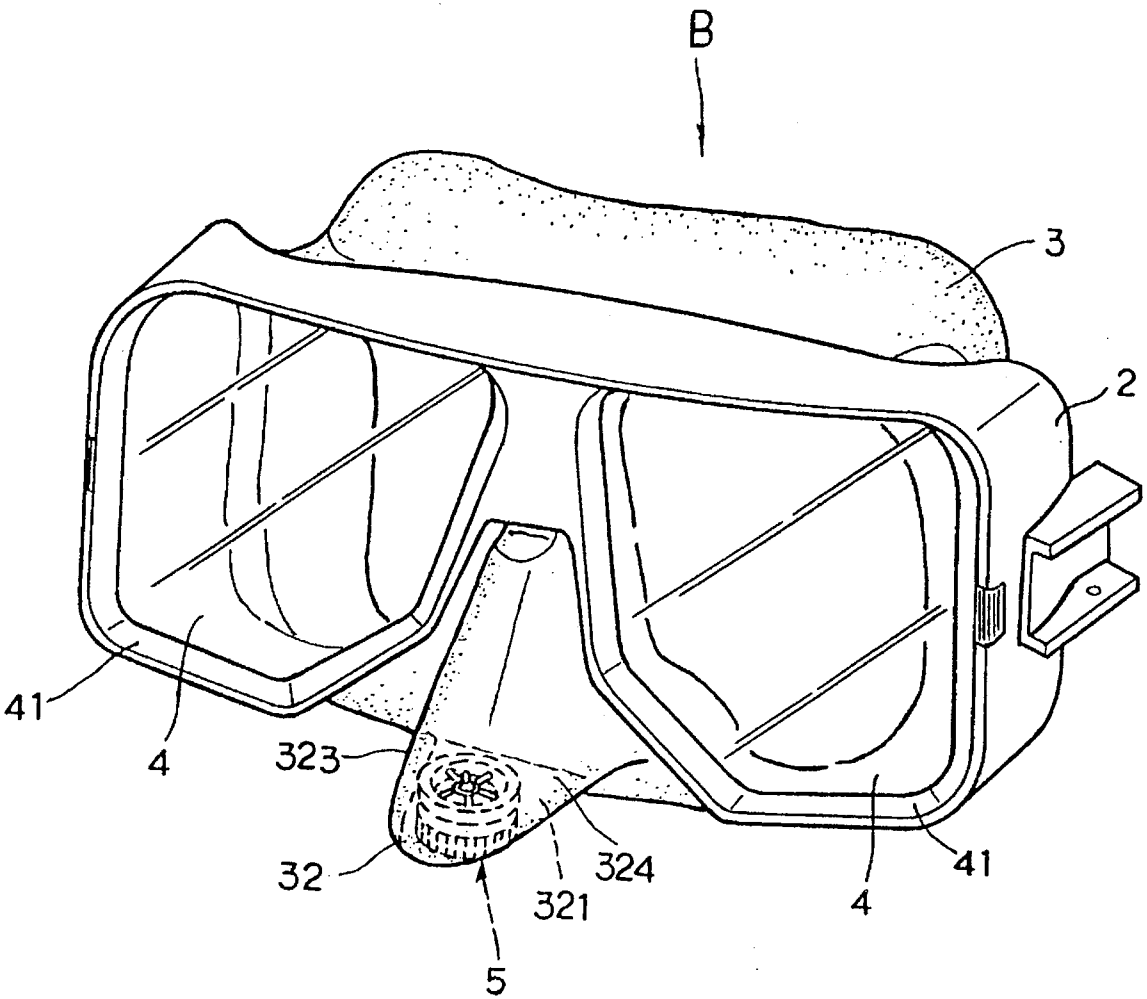
FIG. 5 is an elevational view of one example of a soft nose projection diving mask with a drain mechanism according to the present invention.
Figure 6:
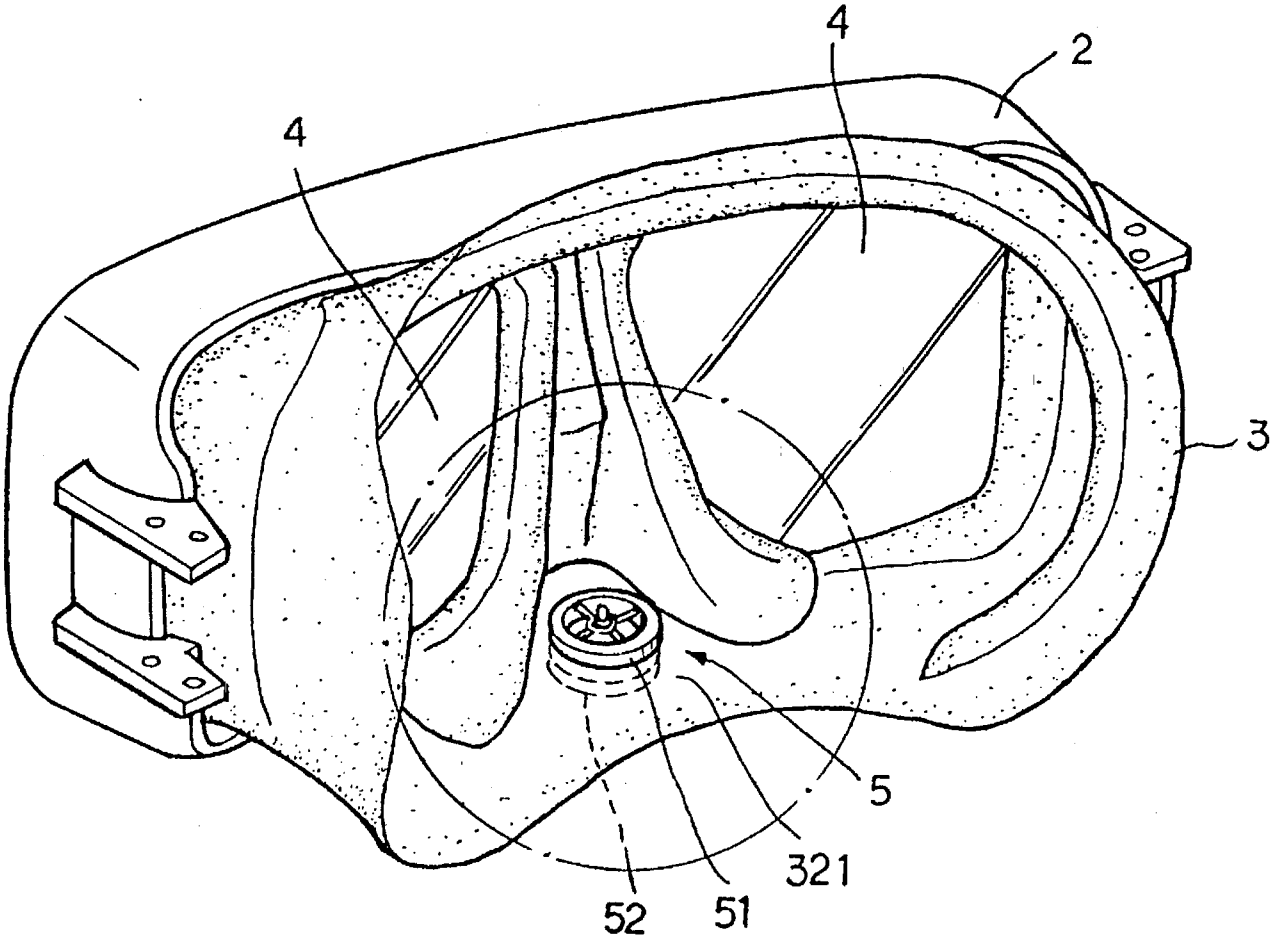
FIG. 6 is an elevational rear view of FIG. 5.
Figure 7:
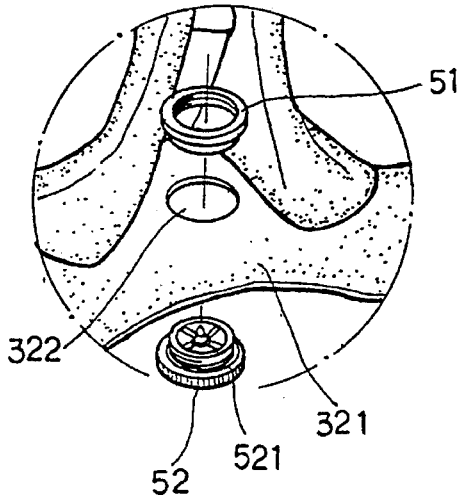
FIG. 7 is a partial exploded view of FIG. 6.
Figure 8:
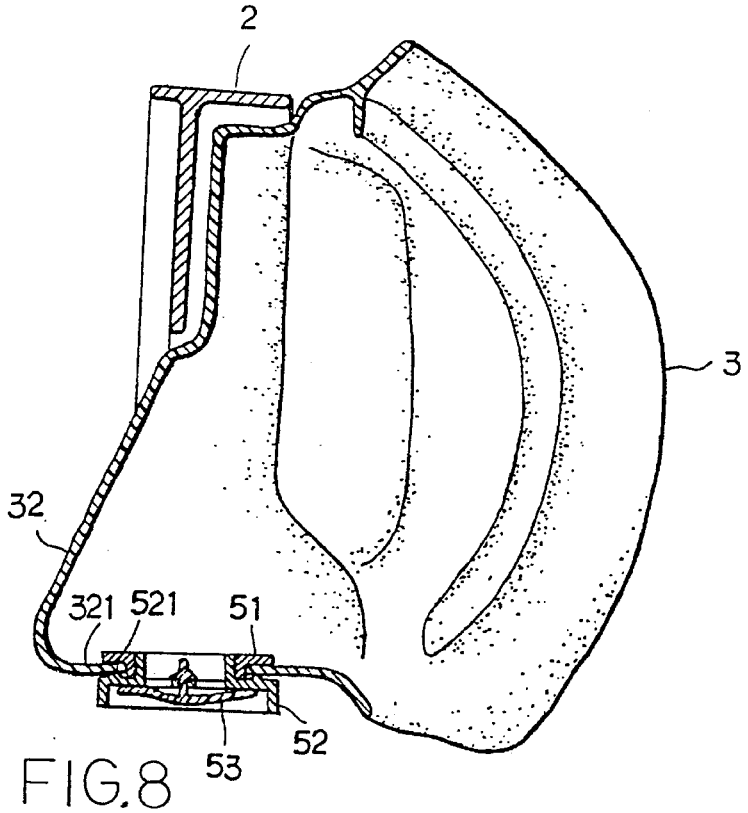
FIG. 8 is a section view of the mask with the drain mechanism of FIG. 7.

The present invention is particularly applied to the monocular or binocular soft nose projection diving mask. The binocular soft nose projection diving mask (B) comprises a goggle frame (2), a soft lining frame (3), two lenses (4), (4). The goggle frame (2) has two separate inner flanges (21), (21). The soft frame (2) has two separate frame rims (31), (31). The soft nose projection body (32) is provided with a drain valve mechanism (5). One example as shown in FIGS. 5 to 8 indicates that a through hole (322) is provided in the nose bottom (321) of the nose projection body (32) of the soft nose projection diving mask (B). A drain valve mechanism (5) consists of an upper valve cover (51) and a lower valve cover (52) is engaged with and through the through hole (322). The valve covers (51), (52) are tightly affixed to the nose bottom (321) of the nose projection body (32) so that there is no leakage. The upper valve cover (51) or the lower valve cover (52) is provided with an unidirectional valve diaphragm (53) that opens outward so that the soft nose projection diving mask (B) has a natural drain activated by the diver's exhalation.

The upper valve cover (51) and the lower valve cover (52) can be assembled with any suitable method such as nesting, screwing, etc. So far as the present example is concerned, the threaded valve covers (51), (52) pass through the through hole (322) at the nose bottom (321) and then are tightly screwed together.

A convex ring (521) is formed on the surface of lower valve cover (52) to engage with the nose bottom (321) to achieve further protection against leakage.

Figure 9:
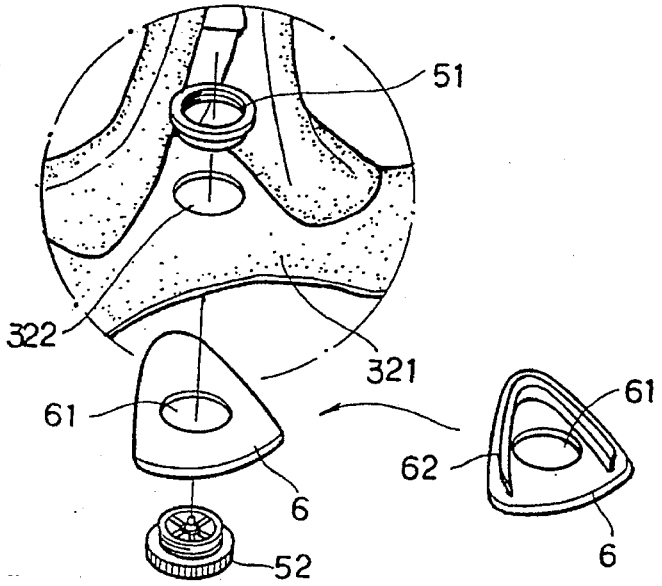
FIG. 9 is a partial exploded view of another example of a soft nose projection diving mask with a drain mechanism according to the present invention.
Figure 10:
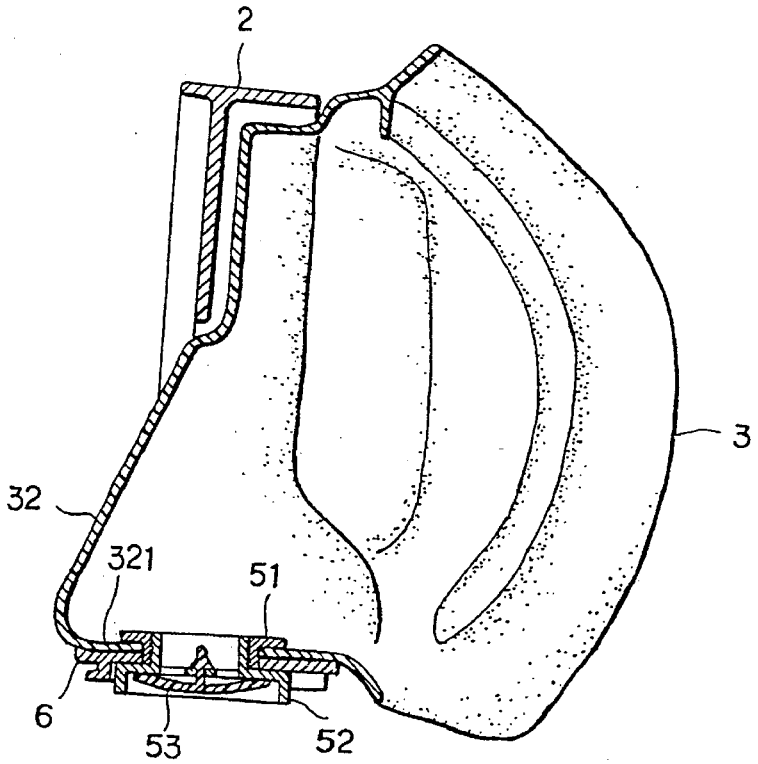
FIG. 10 is a section view of the mask with the drain mechanism.

Another example as shown in FIGS. 9 and 10 indicates that an assembly plate (6) can be attached to the bottom surface of nose bottom (321 ) of the nose projection body (32) and between the nose bottom (321) and the lower valve cover (52). The plate (6) is also provided with a through hole (61). The upper valve cover (51) and the lower valve cover (52) are engaged with each other through the through hole (322) of nose bottom (321) and the through hole (61) of assembly plate (6) so as to increase the stability of nose bottom (321) to support the upper valve cover (51) and the lower valve cover (52).

The assembly plate (6) and the lower valve cover (52) can be made separately or molded integrally.

Figure 11:
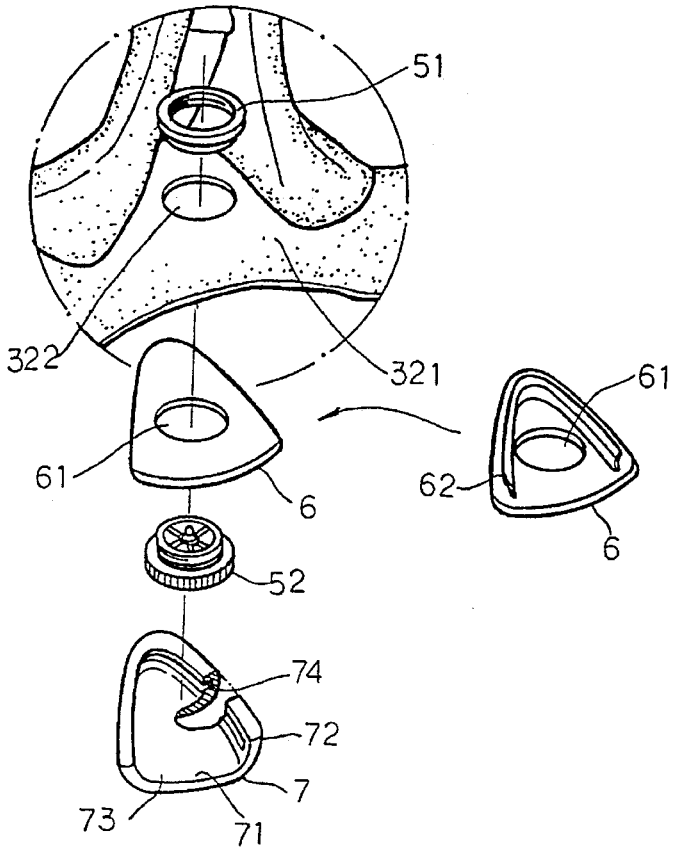
FIG. 11 is a partial exploded view of another example of a soft nose projection diving mask with a drain mechanism according to the present invention.
Figure 12:
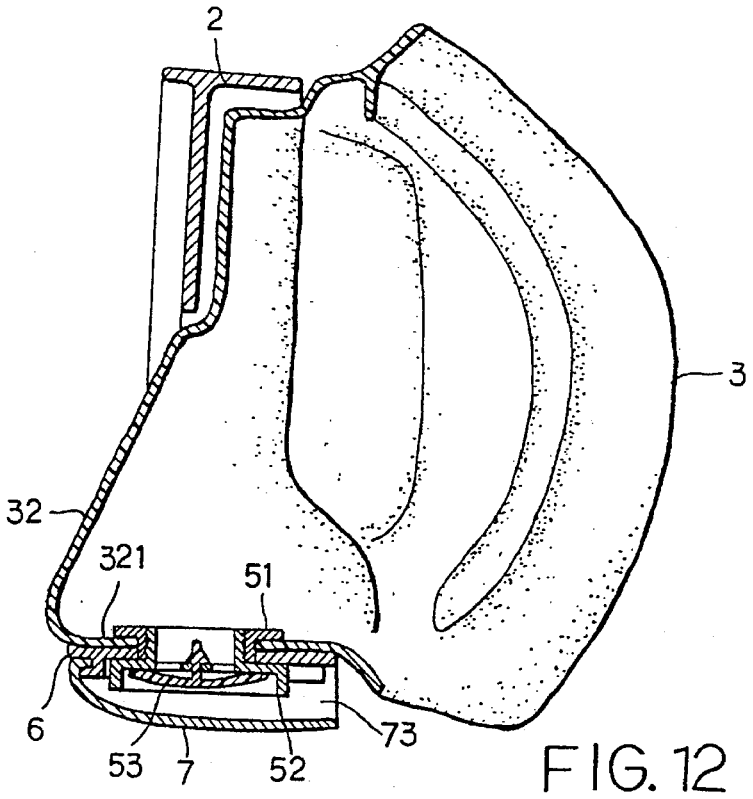
FIG. 12 is a section view of the mask with the drain mechanism of FIG. 11.

Another embodiment as shown in FIGS. 11 and 12, includes the assembly plate (6) with a valve diaphragm guard cover (7) which is a concave cover having a concave plate body (71) and a side wall (72). One end of the concave plate body (71) has no side wall, so that an opening (73) is formed. A recess (74) is formed on the inner wall of side wall (72). the recess (74) is snapped onto a convex track (62) of assembly plate (6) to mount the valve diaphragm guard cover (7) on the assembly plate (6). The concave plate body (71) of valve diaphragm guard cover (7) is disposed to cover the lower side of lower valve cover (52), the opening (73) thereof is oriented to the lower edge at the rear end of nose bottom (321). The valve diaphragm guard cover (7) protects the valve diaphragm (53) from coming off, and also prevents foreign objects such as seaweed and sand from entering into the drain valve mechanism (5), further maintaining the safety of the user. The valve diaphragm guard cover (7) can be removed to conveniently inspect and clean the interior of the drain valve mechanism (5).

Figure 13:
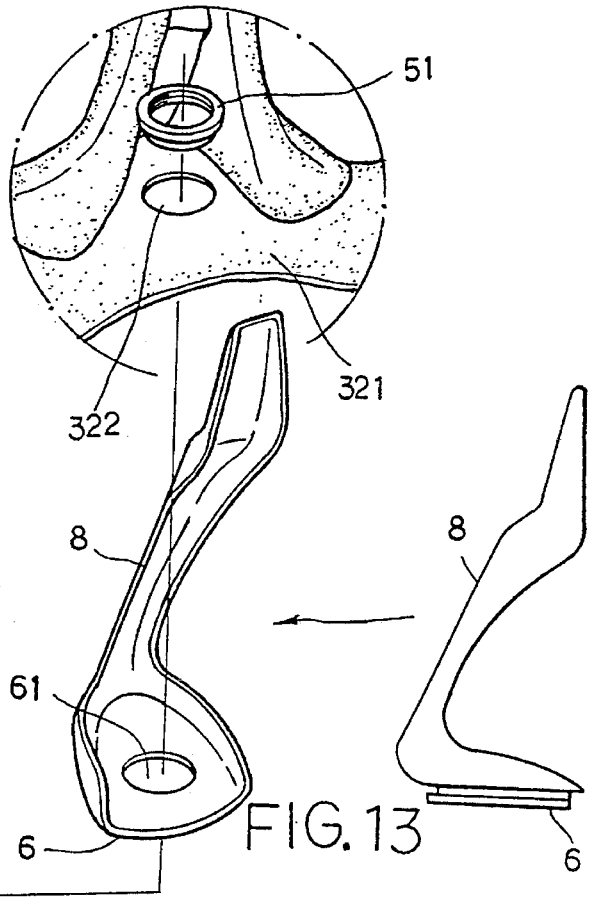
FIG. 13 is a partial exploded view of still another example of a soft nose projection diving mask with a drain mechanism according to the present invention.
Figure 14:
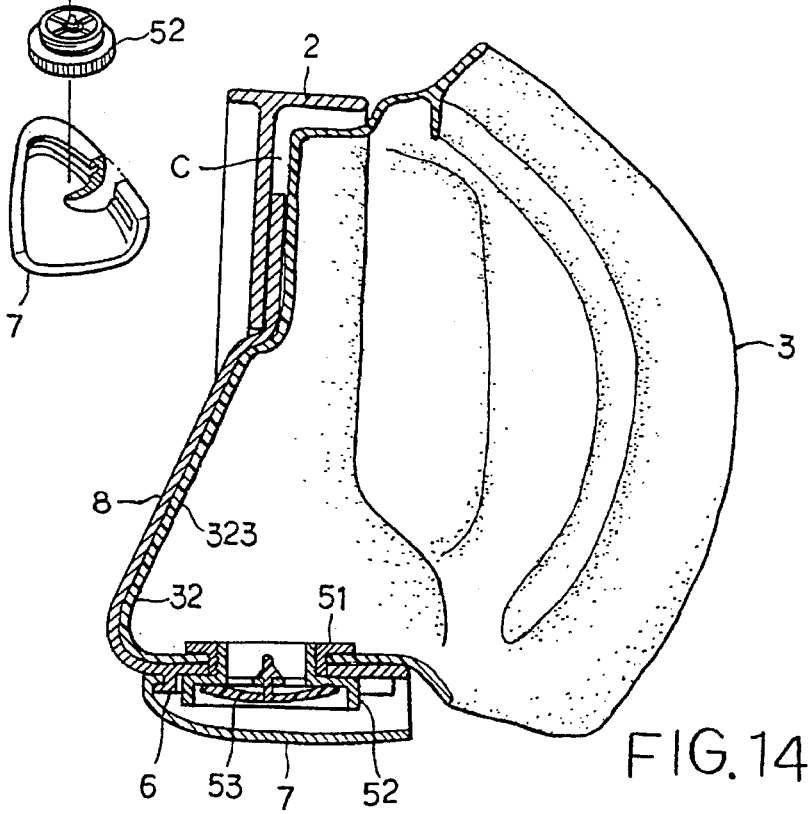
FIG. 14 is a section view of the mask with the drain mechanism of FIG. 13.

Still another example as shown in FIGS. 13 and 14 indicates that a bridge frame (8) is formed on one end of the assembly plate (6) and conforms to the shape of a bridge portion (323) of the nose projection body (32). The upper end of the bridge frame (8) can be inserted in a clearance (C) between the upper end of bridge portion (323) and the goggle frame (2). The bridge frame (8) extends along the bridge portion (323) so that the bridge frame (8) can protect the nose projection body (32) from directly colliding with other object and further stabilizes the nose projection body (32).

Furthermore, the two sides of bridge frame (8) converge toward the center of the user's bridge so as to expose most of the nose flap (324) of nose projection body (32) of the diving mask (B). Therefore, when the diver performs "balancing pressure", the bridge frame (8) will not hinder the diver's holding nose flap (324).

According to the present invention, the soft nose projection body (32) with a drain valve mechanism (5) can give the soft nose projection diving mask (B) an automatic drain actuated by the exhaling action of the diver. The valve diaphragm guard cover (7) can protect the valve diaphragm and guide drain, the bridge frame (8) can protect and stabilize the soft nose projection body (32). Since the nose projection body (32) is soft, when the diver is "balancing pressure", he can simply and easily hold the nose flap (324) of nose projection body (32) with only one hand, so that operation of "balancing pressure" is very simple, convenient and practical.

I claim:

1. A soft nose projection diving mask with a drain mechanism comprising:

a goggle frame with an inner flange:

a soft lining frame with at least one frame rim and a nose projection body, the nose projection body has a nose bottom, a bridge part, and a nose flap, and the soft lining frame is nested in the inner flange of the goggle frame through said at least one frame-rim:

at least one lens nested in the inner flange of the goggle frame; and at least one fixed hoop nested in the inner flange of the goggle frame, the fixed hoop and the inner flange jointly hold said at least one frame rim of the soft lining frame and the rim of the lens; wherein:

a through hole is provided in the nose bottom of the nose projection body of the soft lining frame;

an upper valve cover and a lower valve cover are assembled so as to pass through the through hole, the adjoining surfaces of the upper and lower valve covers are tightly fixed on the nose bottom so as to be leakproof;

at least one of the upper and lower valve covers is provided with a unidirectional valve diaphragm that opens outward and is activated by a diver's exhalation.

2. The soft nose projection diving mask as claimed in claim 1, wherein:

a convex ring is formed on the surface of the lower valve cover that contacts the nose bottom to further prevent leakage.

3. The soft nose projection diving mask as claimed in claim 1, wherein:

an assembly plate is affixed to a bottom surface of the nose projection body, a through hole is provided in the assembly plate, the upper and lower valve covers are assembled through the through holes on the nose bottom and the assembly plate so as to increase the stability of the nose bottom.

4. The soft nose projection diving mask as claimed in claim 1, wherein:

the assembly plate and the lower valve cover are integral.

5. The soft nose projection diving mask as claimed in claim 1, wherein:

the assembly plate and the lower valve cover are separate pieces.

6. The soft nose projection diving mask as claimed in claim 3, wherein:

a bridge frame is formed at a lower end of the assembly plate, the shape of the bridge frame conforming to that of a bridge portion of the nose projection body, an upper end of the bridge frame is inserted in a clearance between an upper end of the bridge portion and the goggle frame so that the bridge frame protects and further stabilizes the nose projection body.

7. The soft nose projection diving mask as claimed in claim 4, wherein:

a bridge frame is formed at a lower end of the assembly plate, the shape of the bridge frame conforming to that of a bridge portion of the nose projection body, an upper end of the bridge frame is inserted in a clearance between an upper end of the bridge portion and the goggle frame so that the bridge frame protects and further stabilizes the nose projection body.

8. The soft nose projection diving mask with a drain mechanism as claimed in claim 3, wherein:

the assembly plate is provided with a valve diaphragm guard cover comprising a concave plate having a concave plate body and a side wall with an opening therein, an inner wall of the side wall includes a recess, the recess fits over a convex track on the assembly plate, thereby securing the valve diaphragm guard cover to the assembly plate, the concave plate body of the valve diaphragm guard cover is disposed to cover a lower side of the lower valve cover.

9. The soft nose projection diving mask with a drain mechanism as claimed in claim 4, wherein:

the assembly plate is provided with a valve diaphragm guard cover comprising a concave plate having a concave plate body and a side wall with an opening therein, an inner wall of the side wall includes a recess, the recess fits over a convex track on the assembly plate, thereby securing the valve diaphragm guard cover to the assembly plate, the concave plate body of the valve diaphragm guard cover is disposed to cover a lower side of the lower valve cover.

10. The soft nose projection diving mask with a drain mechanism as claimed in claim 6, wherein:

the assembly plate is provided with a valve diaphragm guard cover comprising a concave plate having a concave plate body and a side wall with an opening therein, an inner wall of the side wall includes a recess, the recess fits over a convex track on the assembly plate, thereby securing the valve diaphragm guard cover to the assembly plate, the concave plate body of the valve diaphragm guard cover is disposed to cover a lower side of the lower valve cover.

11. The soft nose projection diving mask with a drain mechanism as claimed in claim 7, wherein:

the assembly plate is provided with a valve diaphragm guard cover comprising a concave plate having a concave plate body and a side wall with an opening therein, an inner wall of the side wall includes a recess, the recess fits over a convex track on the assembly plate, thereby securing the valve diaphragm guard cover to the assembly plate, the concave plate body of the valve diaphragm guard cover is disposed to cover a lower side of the lower valve cover.

* * * * *